United States Patent [19]

Tershak et al.

[11] Patent Number: 4,834,169

[45] Date of Patent: May 30, 1989

[54] APPARATUS FOR CONTROLLING A REFRIGERATOR IN LOW AMBIENT TEMPERATURE CONDITIONS

[75] Inventors: Andrew T. Tershak, Center Township, Vanderburgh County; Charles G. Fellwock, Scott Township, Vanderburgh County, both of Ind.; Michael D. Thieneman, Lincoln Township, Berrien County, Mich.

[73] Assignee: Whirlpool Corporation, Benton Harbor, Mich.

[21] Appl. No.: 588,304

[22] Filed: Mar. 12, 1984

[51] Int. Cl.[4] ..... G05D 23/32; F25B 41/00; F25D 17/04

[52] U.S. Cl. ..... 165/30; 62/158; 62/208; 62/187; 62/229; 340/588

[58] Field of Search ..... 62/158, 208, 231, 155, 62/187, 199, 200, 229; 165/30; 340/588, 589

[56] References Cited

U.S. PATENT DOCUMENTS

| | | | |
|---|---|---|---|
| Re. 27,990 | 4/1974 | Rivard et al. | 62/419 |
| 2,042,384 | 5/1936 | Bird et al. | 165/30 |
| 2,133,949 | 10/1938 | Buchanan | 62/199 |
| 2,133,962 | 10/1938 | Shoemaker | 62/199 |
| 2,209,102 | 7/1940 | Newton | 62/208 |
| 2,724,576 | 11/1955 | Jacobs | 165/30 |
| 2,724,577 | 11/1955 | Murphy | 165/30 |
| 3,050,955 | 8/1962 | Solley, Jr. et al. | 62/155 |
| 3,084,519 | 4/1963 | Hanson et al. | 62/155 |
| 3,126,716 | 3/1964 | De Witte | 62/156 |
| 3,359,751 | 12/1967 | Stevens | 62/186 |
| 3,375,679 | 4/1968 | Helsel | 62/441 |
| 3,447,747 | 6/1969 | McHale | 236/49 |
| 3,478,818 | 11/1969 | Kohya et al. | 165/30 |
| 3,483,919 | 12/1969 | Wakai et al. | 165/30 |
| 3,508,605 | 4/1970 | Kusuda et al. | 165/30 |
| 3,645,108 | 2/1972 | Houk | 62/187 |
| 3,733,841 | 5/1973 | Gelbard | 62/208 X |
| 3,796,892 | 3/1974 | Stewart | 62/158 |
| 3,889,895 | 8/1975 | Blanton et al. | 62/158 X |
| 4,184,340 | 1/1980 | Laughlin et al. | 62/158 X |
| 4,286,438 | 9/1981 | Clarke | 62/208 X |
| 4,297,851 | 11/1981 | Paddock et al. | 340/588 |
| 4,387,578 | 6/1983 | Paddock | 165/11.1 |
| 4,439,998 | 4/1984 | Horvay et al. | 62/200 X |
| 4,460,123 | 7/1984 | Beverly | 62/231 |
| 4,467,616 | 8/1984 | Kitauchi | 62/158 |
| 4,481,787 | 11/1984 | Lynch | 62/229 X |
| 4,493,191 | 1/1985 | Hanson | 62/126 |
| 4,519,215 | 5/1985 | Barnett | 62/229 X |
| 4,528,821 | 7/1985 | Tershak et al. | 62/156 X |

FOREIGN PATENT DOCUMENTS

| | | | |
|---|---|---|---|
| 0045728 | 2/1982 | European Pat. Off. | 62/161 |
| 2231769 | 4/1979 | Fed. Rep. of Germany | 62/208 |
| 0128136 | 11/1978 | Japan | 62/158 |
| 0153049 | 8/1984 | Japan | 62/158 |

*Primary Examiner*—Albert W. Davis, Jr.
*Assistant Examiner*—John K. Ford
*Attorney, Agent, or Firm*—Wood, Dalton, Phillips Mason & Rowe

[57] ABSTRACT

A refrigerator control for operating a refrigerator which may experience an abnormal temperature condition due to operation in low ambient temperatures includes a temperature sensor for sensing the temperature of a portion of a refrigerator compartment in order to detect an abnormally low temperature in another portion of the compartment. If the compartment temperature at the end of a predetermined length of time since cooling was last supplied to the compartment is below a predetermined value, then an abnormal condition is assumed to exist and corrective action is taken to eliminate the abnormal condition. A preferred form of corrective action is to prevent compressor re-energization until the compartment temperature reaches a second predetermined value.

28 Claims, 12 Drawing Sheets

FIG. 1
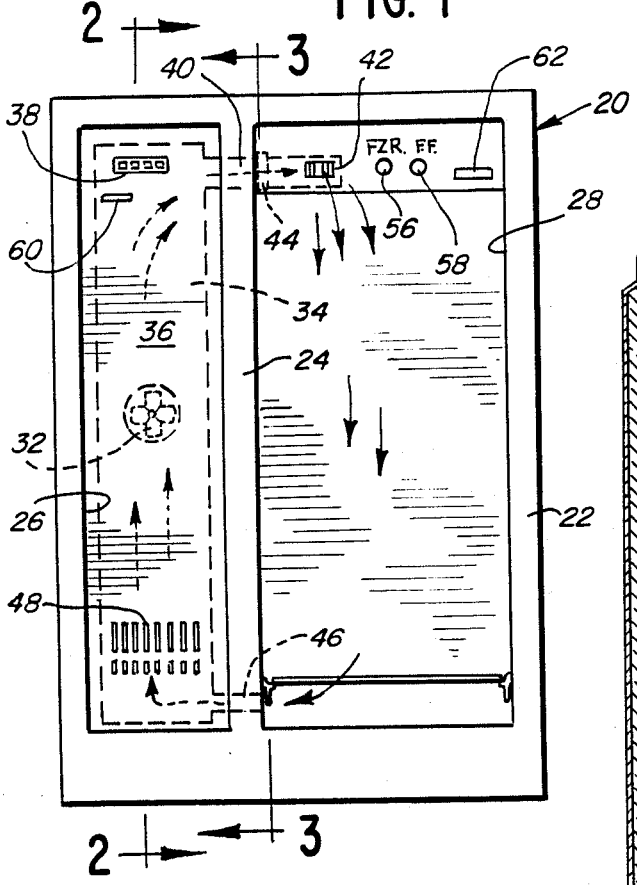
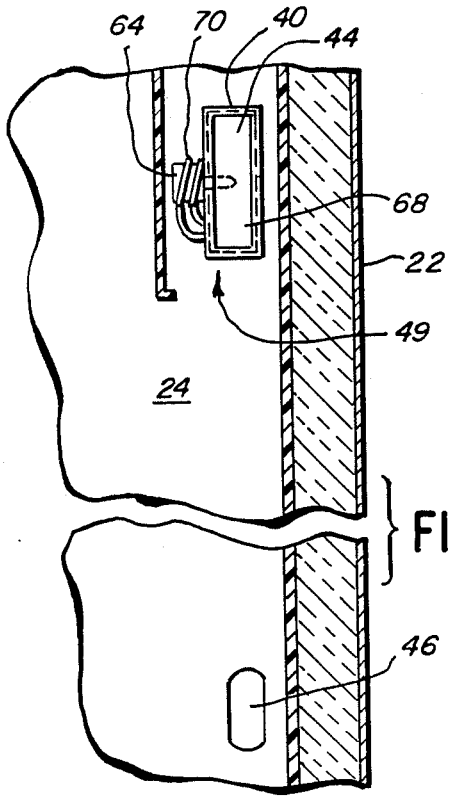
FIG. 3
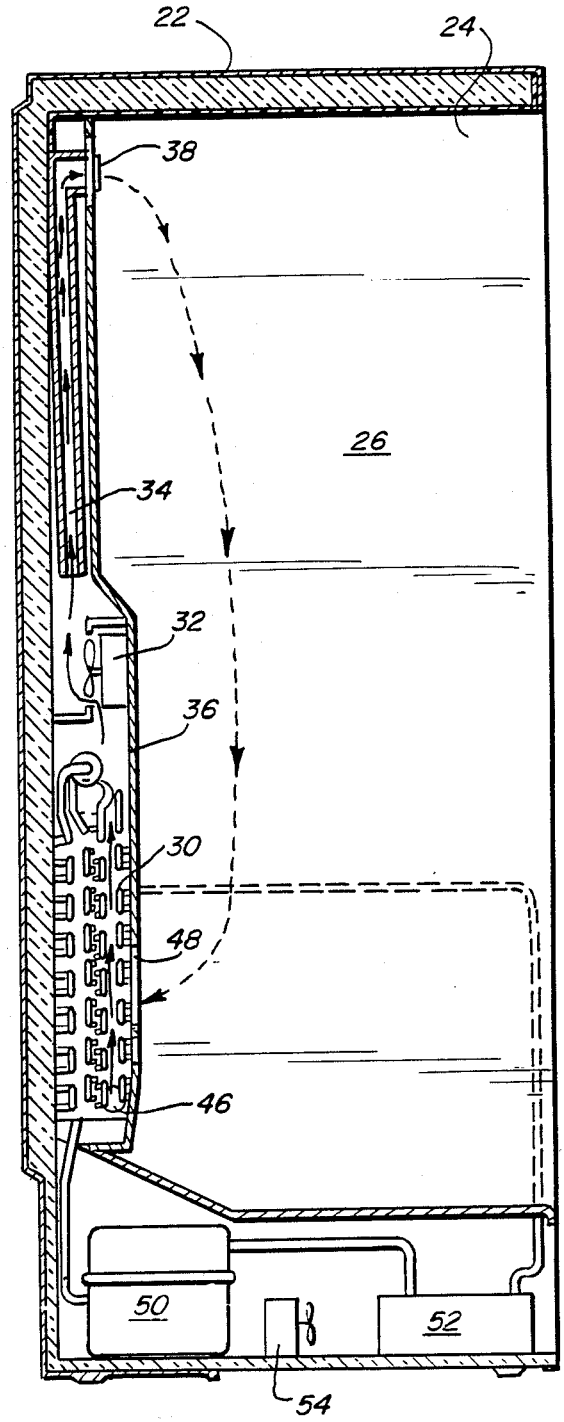
FIG. 2

C

173
FRZ CRSP FLAG FCFG SET ?
YES
NO
174
IS F.F. COMP. TEMP. GT OR LTE F.F. SET PT. ?
LTE
GT
176
LESS THAN BY 2°F OR MORE ?
NO
YES
184
GREATER THAN BY 2°F OR MORE ?
NO
YES
178
IS CMPR. ON ?
NO
YES
180
TURN DAMPER HEATER OFF
182
TURN DAMPER HTR. & EVAP. FAN OFF
186
TURN ON DAMPER HEATER & EVAP. FAN
188
RESET DAMPER OFF TIME FLAG DOFG.
190
SET DAMPER HTR. OFF TIME TO 0 SEC.
192
READ FRZ. COMPARTMENT TEMP.
D

FROM BLOCK 150

152
FRZ CRSP FLAG FCFG SET ?
YES
FF COMP. TEMP ≤ 37°F ?
YES
NO
NO
156
RESET FRZ CRSPR FLAG FCFG
154
TURN OFF CRSPR HTR
264
158
FF COMP. TEMP ≤ 35°F ?
YES
162
DAMPER OFF TIME FLAG DOFG SET ?
YES
164
SET FRZ CRSPR FLAG FCFG
NO
TURN ON CRSPR. HTR
266
TO BLOCK 160

D

READ FRZ SET PT.
194
IS FRZ COMP TEMP. GT OR LTE SET PT. ?
196
LTE
GT
TO BLOCK 214
198
LESS THAN BY 5° OR MORE ?
NO
YES
TO BLOCK 200

APPARATUS FOR CONTROLLING A REFRIGERATOR IN LOW AMBIENT TEMPERATURE CONDITIONS

DESCRIPTION

Background of the Invention

The present invention relates generally to refrigerator controls, and more particularly to an improved refrigerator control which reduces the incidence of abnormal temperature conditions within a refrigerated compartment.

Conventional refrigerator controls have been designed to provide good regulation of compartment temperatures when the refrigerator is operated at room temperatures ranging from approximately 70° F. to 100° F. Recently, the increased use of energy conservation measures, such as household thermostat settings below 70° F. and the use of setback thermostats has resulted in refrigerators being operated in ambient temperatures well below 70° F. This, coupled with improved insulation in modern refrigerators, results in the refrigerator compressor remaining off for long periods of time. During these long compressor-off periods, heat transfer through the divider wall separating the freezer and fresh food compartments, along with convective air flow between the compartments through a return air duct and stratification of air within the fresh food compartment can produce an abnormal temperature condition wherein below-freezing temperatures occur in certain portions of the fresh food compartment. This problem is experienced most often in side-by-side refrigerators, primarily due to the large divider wall area separating the compartments which allows a substantial amount of heat transfer between the freezer and fresh food compartments.

Certain types of food, such as fruits and vegetables, are typically stored in the lower portion of the fresh food compartment, often in a separate "crisper" drawer located in a lower portion of the fresh food compartment adjacent the divider wall separating the fresh food compartment from the freezer. This location has been found to be particularly susceptible to below-freezing temperatures during long compressor off cycles, even though the upper portion of the fresh food compartment may remain at an above-freezing temperature as a result of temperature stratification within the compartment.

Prior attempts to prevent the flow of cold air into the fresh food compartment from the freezer compartment (hereinafter termed "reverse convective air flow") are disclosed in Rivard et al U.S. Pat. No. Res. 27,990 and Helsel U.S. Pat. No. 3,375,679. In the Rivard et al reissue patent, a small resistive heater is disposed adjacent the return air duct to set up a current of air which acts in opposition to the cold air flow from the freezer compartment to maintain the desired temperature differential between the freezer compartment and the fresh food compartment during off cycles of the compressor and evaporator fan.

The Helsel patent discloses the use of a flow-responsive check valve which prevents convective air flow through the return air duct during off cycles of the compressor and evaporator fan.

While the above patents disclose apparatus for preventing reverse convective air flow, it has been found that a solution to the problem of reverse convective air flow does not, of itself, provide a reliable solution to the problem of abnormally low temperatures in particular portions of the fresh food compartment.

SUMMARY OF THE INVENTION

In accordance with the present invention, the existence of an abnormally low temperature condition in a particular portion of the fresh food compartment is detected by sensing the compartment temperature at a location remote from the particular location and monitoring the elapsed time since cooling was last supplied to the compartment. If the sensed temperature within the compartment fails to rise to a predetermined temperature within a particular length of time since cooling was last supplied to the compartment, a determination is made that an abnormal temperature condition has arisen. Corrective action is then taken to eliminate the abnormal condition.

In a first embodiment of the invention, the corrective action comprises preventing operation of cooling means, including a compressor and an evaporator fan, until the sensed temperature within the fresh food compartment rises above a particular level. In this event, even though the temperature within the freezer compartment may rise enough to exceed a user-selected set point, cooling will not be initiated until the fresh food compartment temperature has risen to the particular level. In this fashion, further cooling is unequivocally prevented until the fresh food compartment temperature indicates that the abnormal condition has ceased to exist.

In alternative embodiments of the invention, different types of corrective action are taken upon the occurrence of an abnormal temperature condition in the fresh food compartment.

In a first alternative embodiment of the invention, the evaporator fan is operated and a controllable damper between the freezer compartment and the fresh food compartment is closed, so that a small negative pressure is created on the freezer side of the return air duct, thereby preventing a reverse convective air flow which would drain heat from the fresh food compartment.

In a second alternative embodiment, the freezer compartment set point is automatically adjusted to a warmer temperature so that cooling is delayed beyond the point at which cooling would have been provided had the set point not been changed. This delay allows the fresh food compartment to warm to a higher temperature before cooling is subsequently provided, and hence corrects the abnormal condition.

In a third alternative embodiment of the invention, the corrective action comprises energization of a low wattage heater near the crisper drawer of the fresh food compartment whenever the abnormal temperature condition is detected. During the time the heater is energized, the controllable damper is maintained in a closed state. This action increases the temperature in the vicinity of the crisper and hence eliminates the abnormal condition.

In a fourth alternative embodiment of the invention, the controllable damper is controlled by a temperature control routine and the low wattage heater is energized only when the damper is closed by the routine.

The present invention is implemented by means of a microcomputer, which may also incorporate the temperature control routine and other functions of the refrigerator.

The temperature sensing function is accomplished by means of the temperature sensors already incorporated in the compartments of the refrigerator for the temperature control routine, and hence additional temperature sensors are not required. Consequently, the present invention may be implemented in a simple and inexpensive manner.

BRIEF DESCRIPTION OF THE DRAWINGS

FIG. 1 is an elevational view of a refrigerator with the compartment doors removed to reveal the components therein;

FIG. 2 is a sectional view along the lines 2—2 of FIG. 1;

FIG. 3 is a partial sectional view along the lines 3—3 of FIG. 1;

FIGS. 8A and 8B illustrate the changes to the control program shown in FIGS. 7A-7D to implement a first alternative embodiment of the invention;

FIGS. 1A-11D illustrate the changes to the control program shown in FIGS. 7A-7D to implement a fourth alternative embodiment of the invention.

DESCRIPTION OF THE PREFERRED EMBODIMENT

Figure 4:
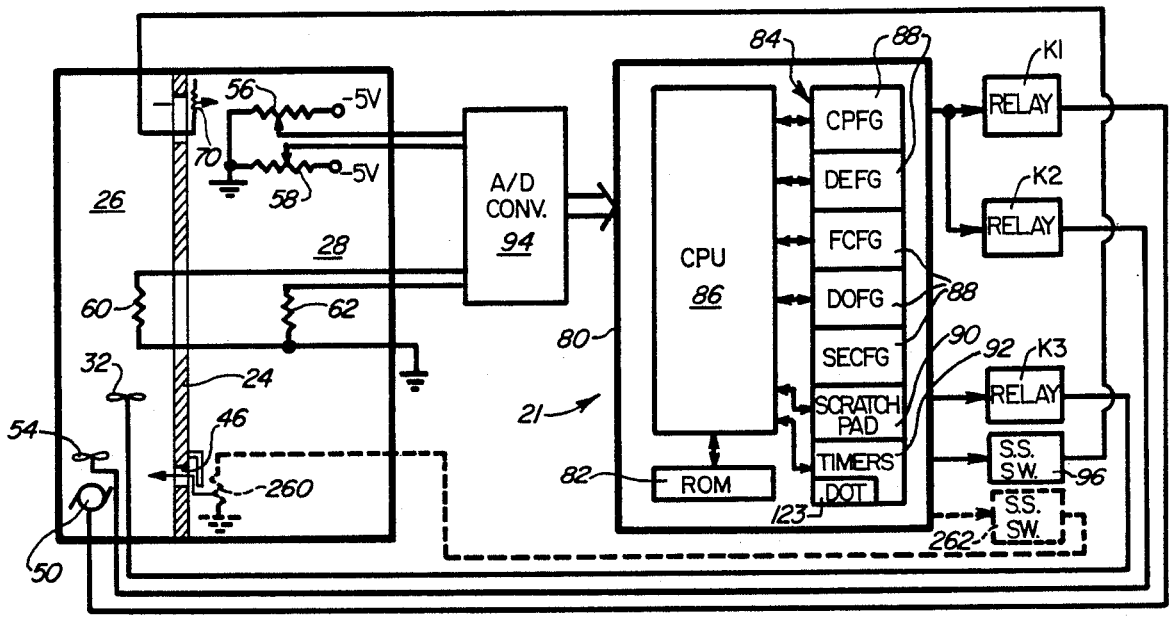
FIG. 4 is a block diagram of control circuitry for operating the refrigerator shown in FIGS. 1-3 according to the present invention.

Referring now to FIGS. 1 and 2, there is illustrated a conventional refrigerator 20 which includes a refrigerator control 21 (shown in FIG. 4) according o the present invention. The control 21 may be mounted inside the refrigerator 20 or may be external to it. The refrigerator 20 is shown in the figures as being a side-by-side refrigerator; however, a different type of refrigerator may be used in conjunction with the control 21 of the present invention, the side-by-side refrigerator being illustrated since it is particularly susceptible to an abnormal temperature condition when the refrigerator is operated in low ambient temperature conditions.

The refrigerator 20 includes a cabinet 22 which in turn includes an insulating internal compartment separator or divider wall 24 separating a below-freezing compartment 26 from a fresh food or above-freezing compartment 28. A pair of doors seal off the freezer and fresh food compartments 26,28 from the outside.

The freezer and fresh food compartments 26,28 are cooled by circulating refrigerated air therethrough. The air is refrigerated as a result of being passed in heat exchange relationship with a conventional evaporator 30 and is forced by an evaporator fan 32 through an air duct 34 behind a rear wall 36 of the freezer compartment 26 through a freezer compartment discharge outlet 38. The air duct 34 is also coupled by means of a passage 40 through the divider wall 24 to a fresh food compartment discharge outlet 42. A controllable damper 44 is located within the passage 40 and is operated by the control of the present invention to control the passage of refrigerated air into the fresh food compartment 28.

The refrigerated air that passes through the passage 40 circulates within the fresh food compartment and returns to the evaporator compartment through a return air duct 46 located in the bottom rear portion of the fresh food compartment 28. The refrigerated air in the freezer compartment 26 returns to the evaporator compartment through an inlet 48 and mixes with the air returned from the fresh food compartment. The mixed air is forced by the evaporator fan over the evaporator 30 during a cooling cycle to remove heat therefrom and recirculate the air in the compartments 26,28.

In addition to the evaporator 30 and evaporator fan 32, the refrigeration means includes a compressor 50, a condenser 52 and condenser fan 54. The refrigeration means are operated by the refrigerator control of the present invention to control cooling in the compartments 26,28, as will be described.

The desired temperature for each compartment 26,28 may be user-selected by means of freezer and fresh food set point potentiometers 56,58, respectively, which may be disposed within the fresh food compartment 28. Cooling of the compartments is controlled in accordance with outputs from freezer and fresh food compartment temperature sensors 60,62 which are positioned so as to sense the average temperatures within the freezer and fresh food compartments 26,28, respectively. The sensors 60,62 are shown in FIG. 1 as being positioned generally in the upper portion of the compartments 26,28. The particular location for each sensor which best represents the average compartment temperature is determined empirically. In the preferred embodiment, the temperature sensors 60,62 each comprise a thermistor. Other types of temperature sensors may be alternatively utilized, if desired.

The refrigeration apparatus may additionally include defrost means, such as a defrost heater (not shown), which may be positioned adjacent the coils of the evaporator 30 and which is periodically energized by the refrigerator control to defrost the evaporator.

As seen in FIG. 3, the controllable damper 44 includes a temperature responsive bellows assembly 64 which controls the open/closed condition of an air baffle 68 disposed in the passage 40. The bellows assembly 64 and its associated baffle 68 may be of conventional construction. When the temperature of the bellows assembly 64 is below a particular temperature, the baffle 68 is positioned in a closed state to prevent the flow of air through the passage 40. Conversely, when the temperature of the bellows assembly is above the particular temperature, the baffle 68 is moved to an open state, thereby allowing refrigerated air to flow through the passage 40 and into the fresh food compartment 28.

As described in greater detail below, a resistive heating element 70 is disposed about the bellows assembly 64, and the heating element 70 is energized by the refrigerator control of the present invention to control temperature of the bellows 64 and, hence, the open/-closed condition of the baffle 68.

Referring now to FIG. 4, the refrigerator control 21 according to the present invention may be implemented by using discrete digital logic or through the use of a microcomputer. In the preferred embodiment illustrated, a single chip microcomputer 80 is used to implement the refrigerator control. The microcomputer integrated circuit may be a conventional, single chip device and may include on the chip a read only memory or ROM 82 and a random access memory or RAM 84. The microcomputer 80 also includes a central processing unit, or CPU 86 which performs the various computations used in the control process. The ROM 82 contains the control program, the control logic and the constants used during control execution. The RAM 84 contains registers 88 which store various flags used in the control program. Also included in the RAM 84 is a scratch pad memory 90 which stores various intermediate and final results and a series of timers 92.

The inputs to the microcomputer 80 include the freezer and fresh food set point potentiometers 56,58 and the freezer and fresh food temperature sensors 60,62, the outputs of which are first converted to digital signals by an analog-to-digital converter 94. Additional inputs which are not essential to the operation of the present invention are not shown for purposes of clarity.

Outputs from the microcomputer 80 are coupled to control the energization of the compressor 50, the condenser fan 54 and the evaporator fan 32 through relays K1 K2 and K3, respectively. Also controlled by the microcomputer 8 is a solid state switching device 96 which in turn controls the resistive heating element 70 disposed about the temperature responsive bellows assembly 64 of the controllable damper 44.

As previously noted, the temperatures within the compartments 26,28 are controlled in accordance with the data from the set point potentiometers 56,58 and the temperature sensors 60,62. The control system also determines from the output of the fresh food temperature sensor 62 whether an abnormal temperature condition has arisen in the fresh food compartment 28. As mentioned, an abnormally low temperature condition may arise due to operation of the refrigerator 20 in low ambient temperature conditions.

Under normal ambient temperature conditions, the evaporator fan 32, compressor 50, condenser fan 54 and controllable damper 44 are operated so that cooled air is passed as necessary into the freezer and fresh food compartments. Once the temperature of each of the compartments 26,28 reaches a temperature somewhat less than the set point as determined by the settings of the corresponding potentiometer 56,58, the evaporator fan 32, compressor 50 and condenser fan 54 are de-energized. Following this time, heat transfer occurs through the exterior cabinet walls into the refrigerated compartments and causes the compartment temperatures to rise toward or above the respective set points. When the temperature within the fresh food compartment 28 rises above the set point by a predetermined amount, operation of the evaporator fan 32 is initiated while the compressor is maintained in a de-energized state. Under this condition, the controllable damper 44 is maintained in an open state so that air can be circulated from the freezer into the fresh food compartment for cooling. This cooling of the fresh food compartment without operation of the compressor takes advantage of the residual cooling capability of the evaporator and the freezer compartment.

When the temperature within the freezer compartment 26 rises above its set point by a predetermined amount, operation of the compressor is initiated. In the event that the freezer compartment 26 exceeds this temperature before the fresh food compartment 28 exceeds its trip point temperature, the compressor 50, condenser fan 54 and evaporator fan 32 are energized and the damper 44 is maintained in the closed position so that air is not circulated into the fresh food compartment 28.

Figure 5A:
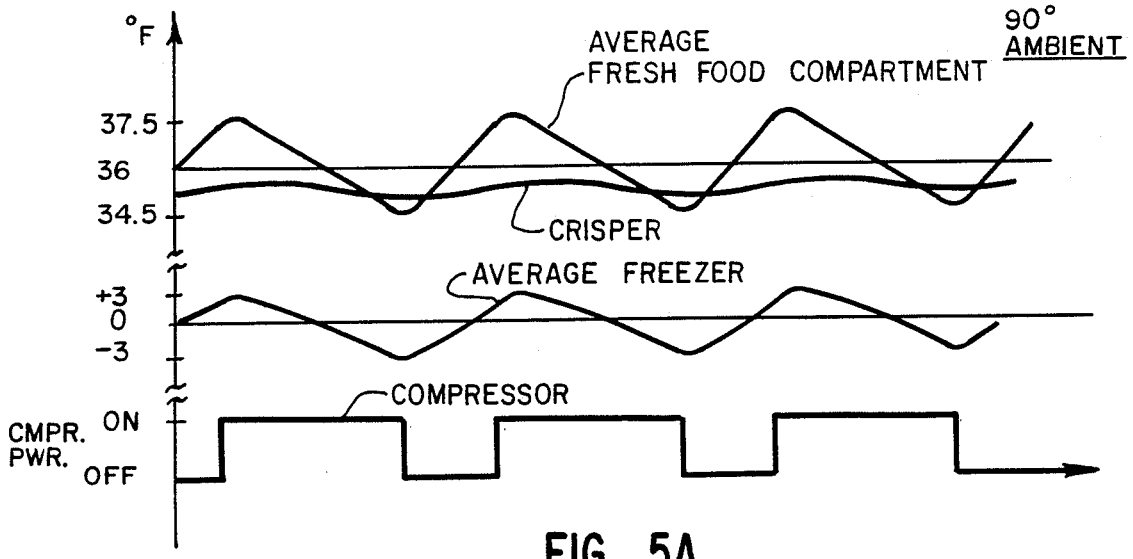
FIGS. 5A-5C is a series of graphs comparing the operation of a conventional refrigerator with the refrigerator shown in FIGS. 1-3.

With reference to FIG. 5A, the operation of a conventional refrigerator of side-by-side configuration in 90° F. ambient temperature conditions is illustrated. The compartment temperatures shown in this figure are true average temperatures obtained by monitoring a plurality of thermocouples within each compartment. As shown, the average fresh food compartment temperature swings between ±1.5° F. of its 36° F. set point temperature, the average freezer compartment temperature swings between ±3° F. of its 0° F. set point temperature, and the temperature of the crisper, which is located in the lower portion of the fresh food compartment, remains above freezing, at between 35° F. and 35.5° F. Also as shown, the compressor run periods are relatively long, as compared to the compressor off periods;

During operation of a conventional refrigerator in low ambient temperature conditions, however, the temperature differential between the fresh food compartment and the ambient temperature may be less than the temperature differential between the fresh food compartment and the freezer compartment. In this case, greater heat transfer may occur through the divider wall than through the exterior cabinet walls. This effect, combined with temperature stratification within the fresh food compartment and reverse convective air flow through the return air duct, may cause the temperature of portions of the fresh food compartment to remain stable, or even decrease during times that the cooling apparatus is de-energized. In essence, the freezer compartment is supplying cooling to the fresh food compartment at a rate which exceeds the heat gained by that compartment through the cabinet walls.

Figure 5B:
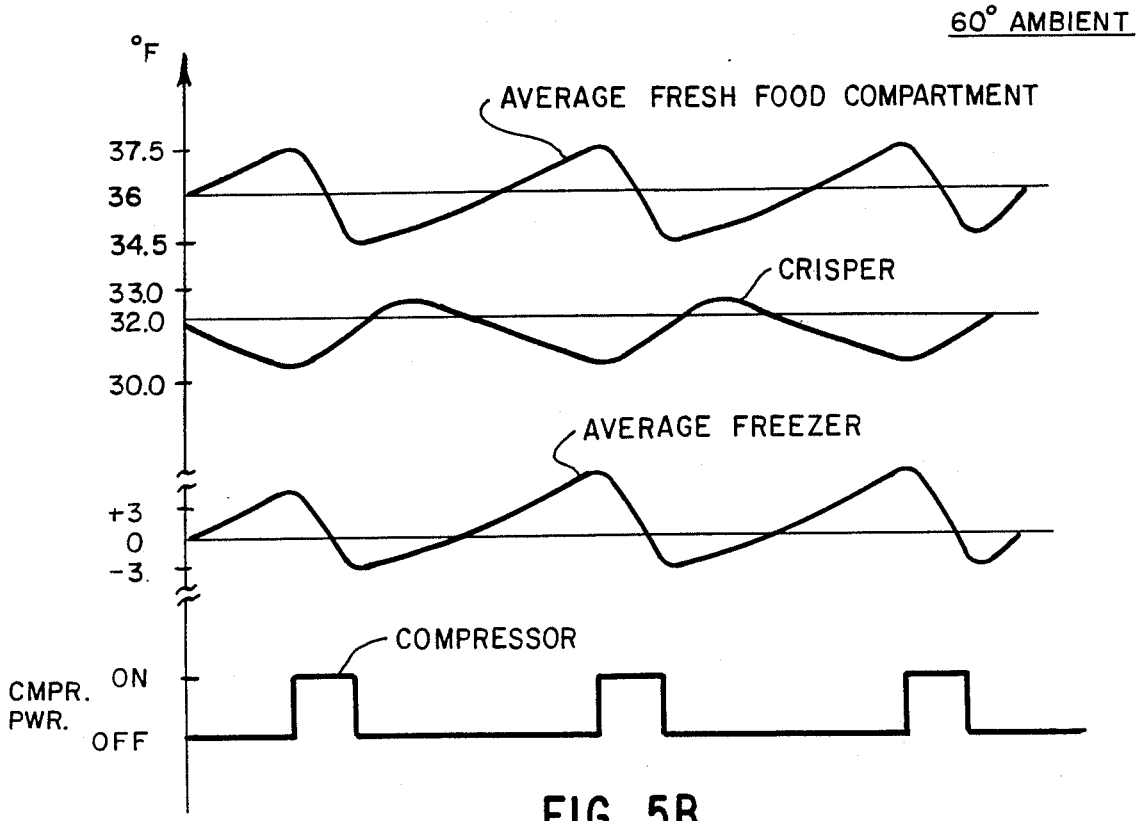

FIG. 5B illustrates the operation of a conventional side-by-side refrigerator in 60° F. ambient temperature conditions. Thus, as illustrated, although the average fresh food compartment temperature still swings between ±1.5° F. of its 36° F. set point, the rate of temperature increase within the fresh food compartment during compressor off cycles is much slower. Also as shown, the compressor experiences relatively long off cycles under such low ambient temperature conditions, and the temperature of the crisper varies between 30.5° F. and 32.5° F., remaining below freezing for much of the time.

As previously noted, the temperature sensor 62 in the fresh food compartment is located to sense a temperature which is representative of the average temperature therein. Typically, the temperature sensor is located in the upper portion of the compartment, a location which is remote from the lower portion of the compartment experiencing the abnormal temperature condition. Under normal operating conditions, the sensor experiences increasing temperatures during off cycles of the cooling apparatus due to stratification of the air within the compartment and heat transfer through the refrigerator walls. During an abnormal temperature condition, however, the temperature in the upper portion of the compartment experiences a different time-temperature relationship than when there is no abnormal condition. In particular, under low ambient conditions the sensed temperature increases more slowly, and may fail to rise to the trip point temperature, even after an extended period of time such as 30 minutes or more. Hence, the existence of an abnormal temperature condition in a particular portion of the fresh food compartment may be sensed by detecting the time-temperature relationship at a location remote from the particular portion so as to detect the occurrence of a low sensed temperature at a particular time following the point at which cooling was last supplied to the compartment.

More specifically, the control 21 of the present invention detects an abnormal condition by initiating timing of an interval once cooling is no longer being actively supplied to the fresh food compartment 28, as determined by the closing of the controllable damper 44. After a predetermined length of time the control 21 detects the output of the fresh food temperature sensor 62, and if the compartment temperature has not reached a predetermined level as of this time, and if the damper 44 is still closed, corrective action is taken to eliminate the undesirably low temperature in the fresh food compartment.

Figure 6:
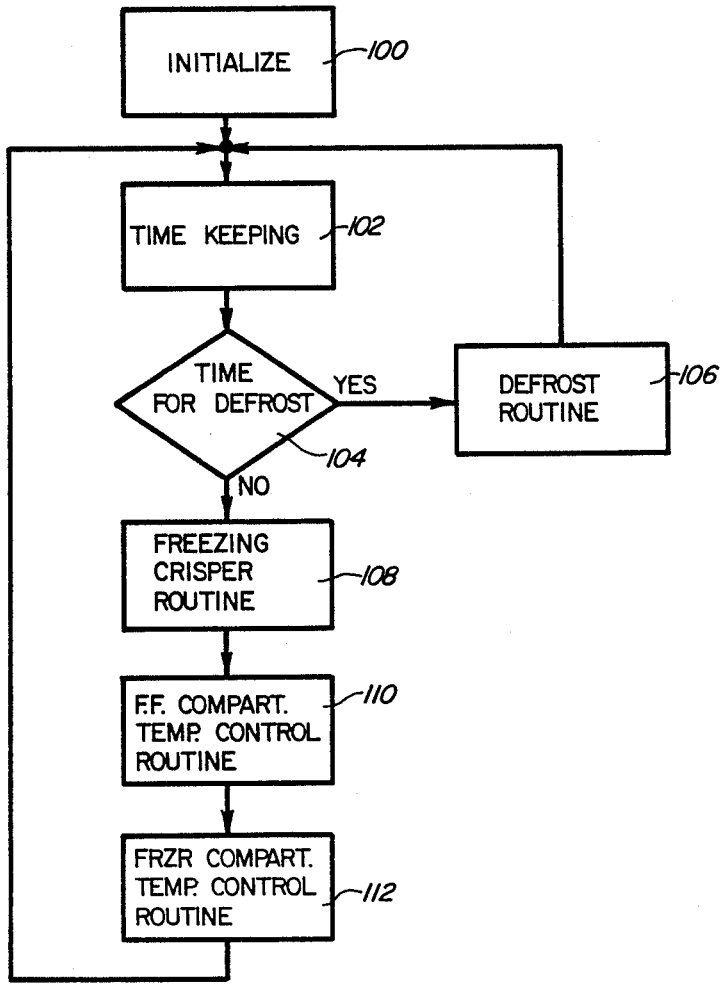
FIG. 6 is a generalized flow chart of the control program incorporated in the refrigerator control shown in FIG. 4.

Referring now to FIG. 6, there is illustrated in block diagram form the overall operation of the refrigerator control 21. A block 100 initializes the various constants and set or resets flags, as appropriate, within registers in the RAM 84. A block 102 then establishes timekeeping functions for the control process.

A block 104 determines whether a defrost operation should be initiated. This determination may be made conventionally, on the basis of elapsed time since the last defrost, or upon other factors, as desired. If the block 104 determines that a defrost operation should be initiated, control is passed to a block 106 to perform the defrost routine. Control from the block 106 returns to the block 102 following defrost.

If it is determined by the block 104 that a defrost operation should not be initiated at this time, control passes to a block 108 which detects the existence of an abnormal condition (or a "frozen crisper" condition) and takes corrective action to eliminate such condition. A pair of blocks 110,112 then effect temperature control of the fresh food and freezer compartments.

Control from the block 112 then returns to the block 102 to continue the control process.

Referring now to FIGS. 7A–7D, there is illustrated a detailed flow chart which more fully illustrates the operation of the refrigerator control 21 shown in general block diagram form in FIG. 6.

The control process begins at a block 120, at which point various flags are initialized. A one-second flag SECFG, a defrost flag DEFG, a frozen crisper flag FCFG, and a damper off time flag DOFG, are each reset. A compressor protect flag CPFG is initially set by the block 120.

A block 122 then sets a series of timers to zero. These timers include a compressor protection timer, a compressor run timer and a damper off timer, or DOT 123, shown in FIG. 4.

A block 124 determines whether one second has elapsed since the last pass through the program. If this is not the case, control remains with the block 124 until a one-second timer in the timer registers 92 has timed out. Following this action, control passes to a block 126 which increments the compressor protection timer and checks to determine whether the timer has accumulated 256 seconds.

The function of block 126 is to prevent short cycling of the compressor 50. In effect, the compressor 50 can have a minimum on or off time of 256 seconds.

If the block 126 determines that the compressor protection timer has elapsed, the compressor protection flag CPFG is reset by a block 128.

A block 130 then determines whether the damper resistance heater 70 is energized by checking the microcomputer output which energizes this element. If the heater 70 is not currently energized, the damper off timer is incremented and checked to determine whether it equals 1800 seconds. If this is the case, control passes to a block 134 which sets the damper off time flag DOFG.

It should be noted that the damper off timer DOT 123 indicates the length of time the damper 44 has been maintained in a closed state, i.e. the length of time since cooling was last provided to the fresh food compartment by the refrigeration apparatus.

If it is determined that the damper heater is on, i.e., the damper door 68 is open and hence cooled air is being supplied to the fresh food compartment, or if it is determined that the damper off time does not equal 1800 seconds, then control passes to a block 136 which determines whether the compressor 50 is energized. This function is accomplished by checking the status of the output line controlling the relays K1 and K2. If the compressor is on, then a block 138 increments the compressor run timer and checks to determine whether it has accumulated 8 hours, or 28,800 seconds of time. If this is the case, then the defrost flag DEFG is set and a defrost operation is initiated. The length of the defrost operation may be controlled by conventional means, such as a temperature responsive bimetallic switch (not shown) mounted on the evaporator and arranged to open at the end of defrost.

If it is determined that the compressor is not on or that the compressor run timer has not accumulated 8 hours of time, then a block 144 checks to determine whether the defrost flag DEFG is set.

If the block 144 determines that the defrost flag is set, control passes to a block 146 which checks to determine whether the defrost routine is complete. If this is not the case, control passes back to the block 124 to continue the defrost routine.

If it is determined that the defrost operation has been completed, then a block 148 resets the defrost flag DEFG and the compressor protection flag CPFG. Additionally, the compressor run timer is reset to zero. Control from the block 148, or from the block 144 in the event that the defrost flag is not set, passes to a block 150, FIG. 7B, which reads the fresh food compartment temperature as detected by the temperature sensor 62. A block 152 then determines whether the frozen crisper flag FCFG is set. If this is not the case, then the flag FCFG is redundantly reset by a block 154.

If the block 152 determines that the frozen crisper flag FCFG is set, indicating that an abnormally low temperature condition exists within the fresh food compartment, then control passes to a block 156 which determines whether the frozen crisper flag should be reset. This is determined by comparing the fresh food compartment temperature to a particular reference temperature, such as 37° F. in the illustrated embodiment. This is determined by detecting the output of the fresh food temperature sensor 62. Since the frozen crisper flag has previously been set, if the block 156 determines that the fresh food compartment temperature is less than or equal to 37° F., this indicates that the abnormally low temperature continues to exist, then the flag FCFG is not reset and control passes to a block 160. It should be noted that once the frozen crisper flag FCFG has been set, the compressor and the evaporator fan are de-energized by portions of the control program subsequent to the block 154, and hence the control program continues to loop with the compressor off until the abnormal condition ceases to exist.

Following the block 154 a block 158 determines whether or not the fresh food compartment temperature is less than or equal to a preselected temperature, such as 35° F. If it is determined that the fresh food compartment temperature is greater than 35° F., then control passes to the block 160 to initiate the fresh food compartment temperature control routine.

If the block 158 determines that the fresh food compartment temperature is less than or equal to 35° F., then a block 162 determines whether the damper off time flag DOFG is set. If this is the case, then an interval of predetermined length has passed since cooling was last provided to the compartments and the fresh food temperature has failed to reach the preselected 35° F. temperature. If this is the case, then an abnormal temperature condition has been detected and control passes to a block 164 which sets the frozen crisper flag FCFG.

If the block 162 determines that the predetermined length of time has not passed since cooling was last supplied to the compartments, control passes to the block 160 which detects the fresh food compartment set point.

Figure 7A:
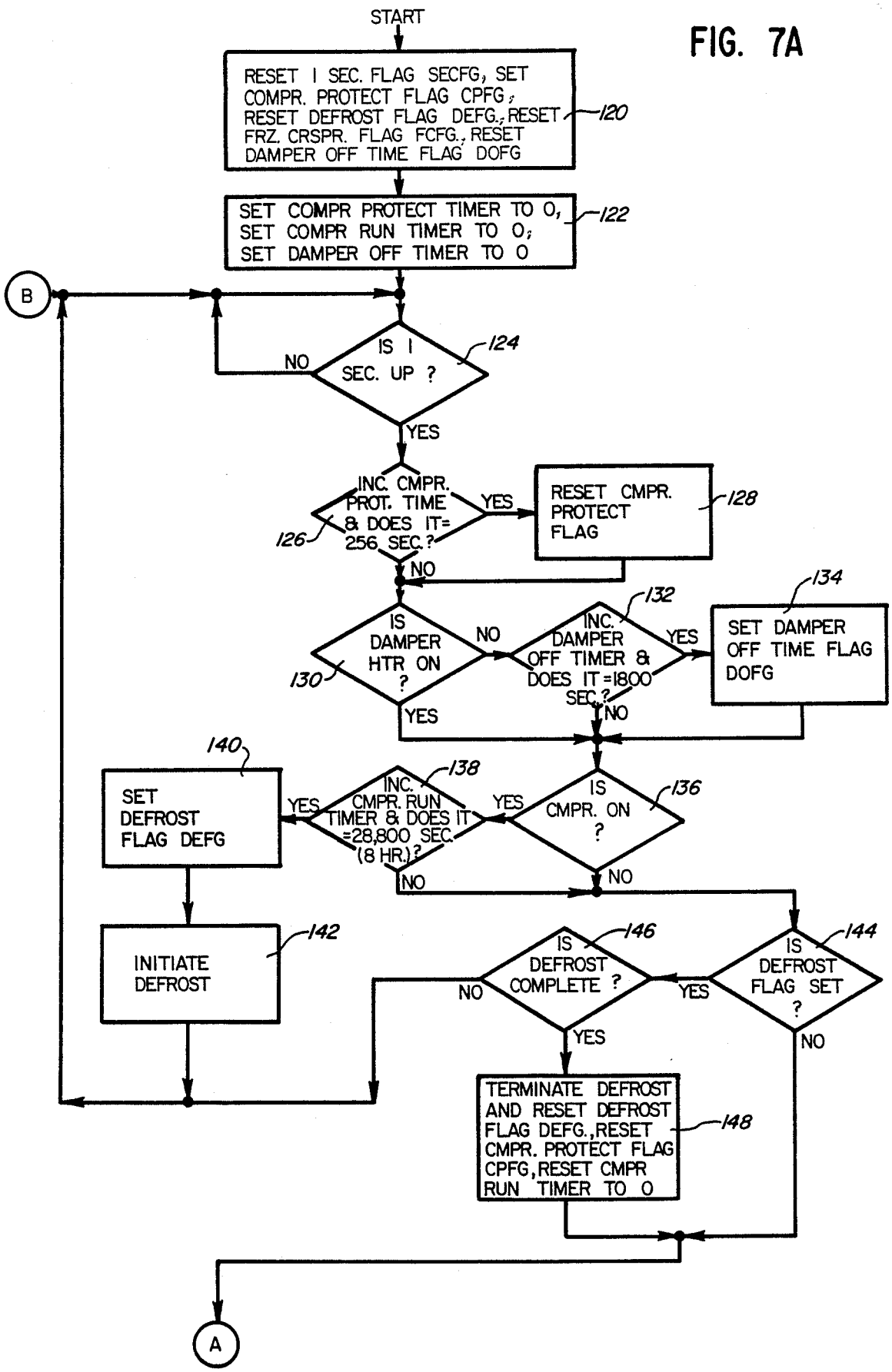
FIGS. 7A-7D, when joined together at similarly lettered lines, together comprise a single detailed flow chart of the control shown in FIG. 6.
Figure 7B:
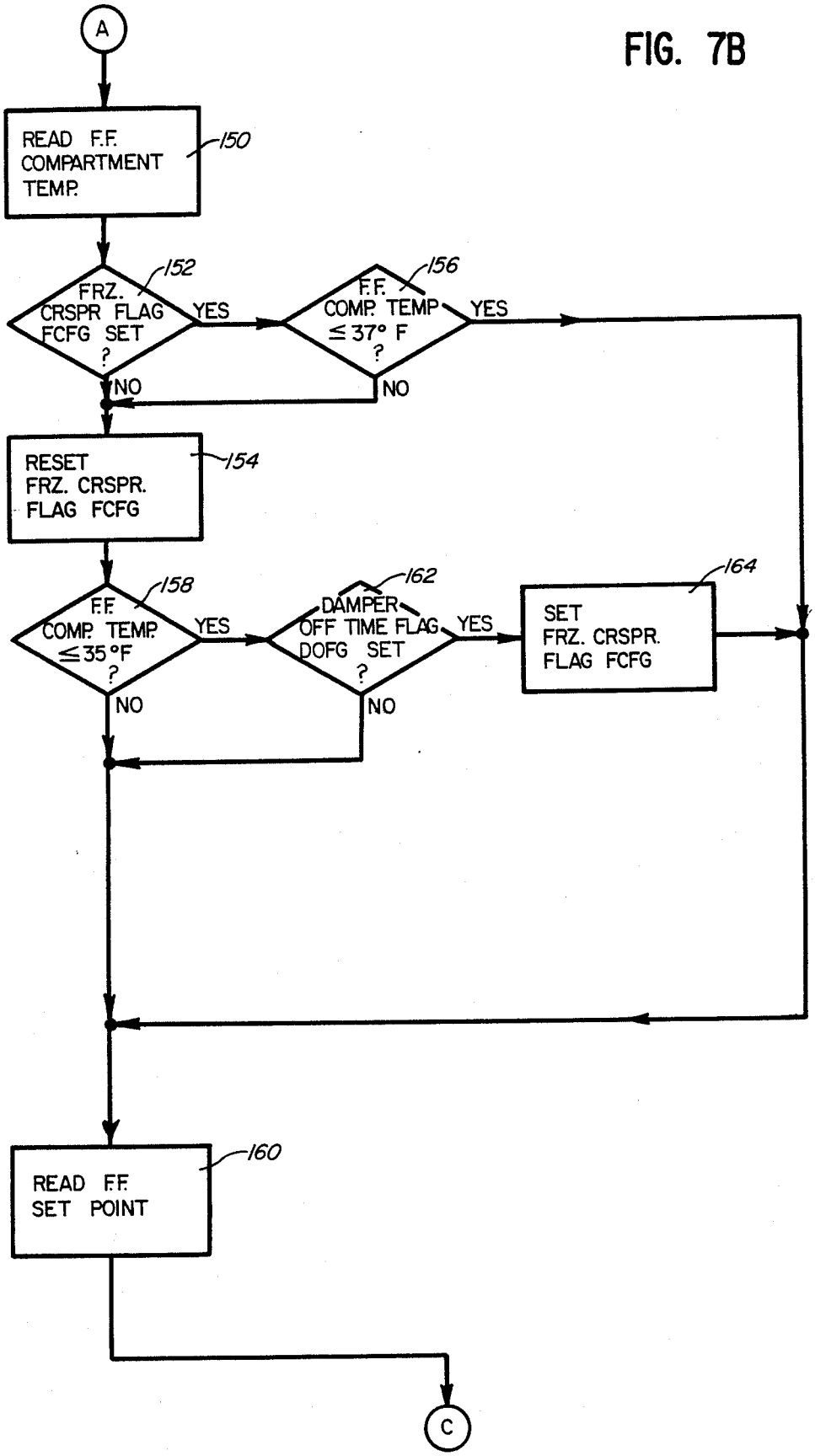
Figure 7C:
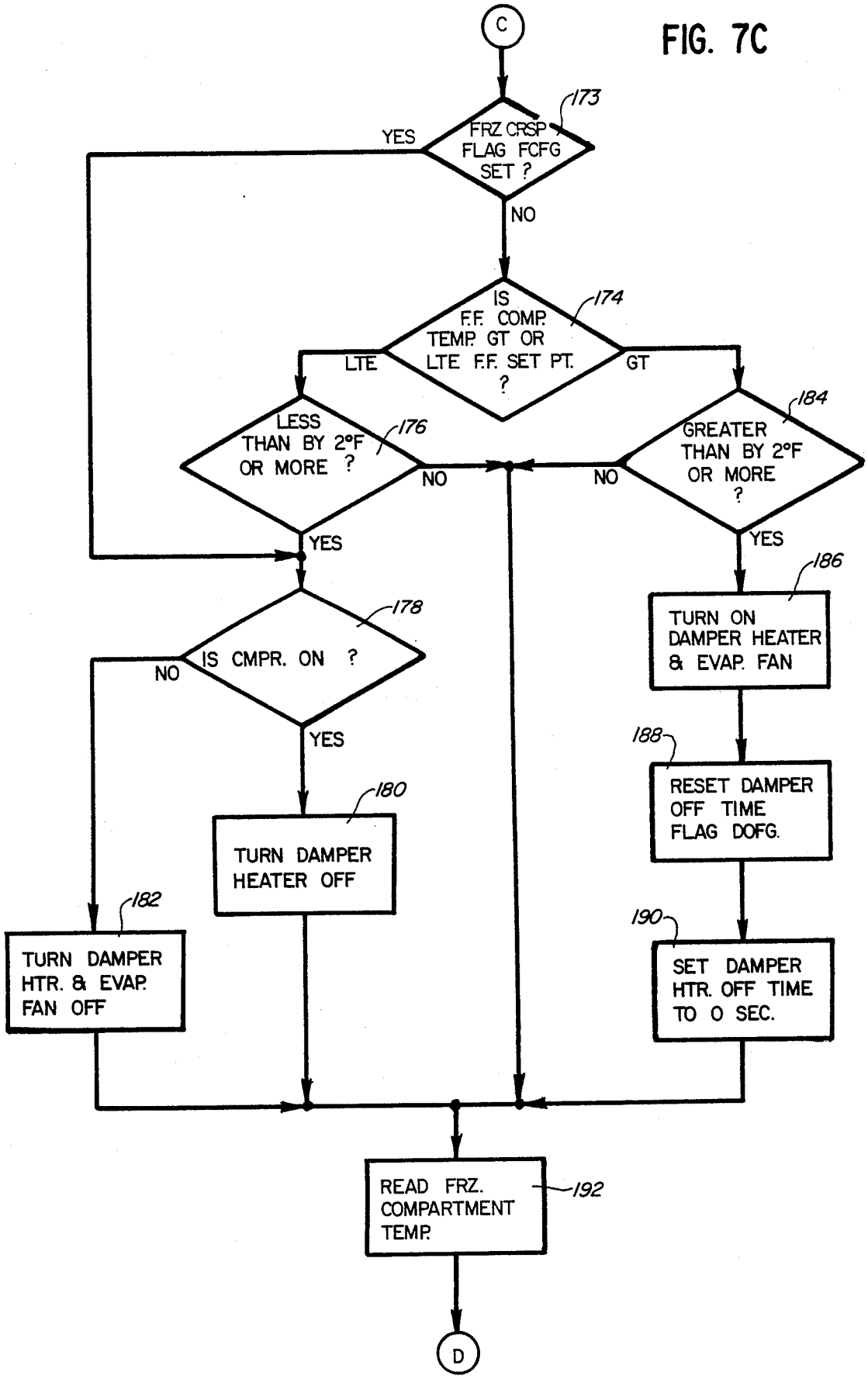

Following the block 160 a block 173, FIG. 7C, checks to determine whether the frozen crisper flag FCFG is set. If so, control passes to a block 178. If not, a block 174 checks to determine the magnitude of the fresh food compartment temperature relative to the fresh food compartment set point. If the compartment temperature is less than or equal to the set point, then a block 176 determines whether the compartment temperature is less than the set point minus 2° F. This 2° F. value is empirically determined and may be varied, if desired.

If the block 176 determines that the compartment temperature is less than the fresh food set point minus 2° F., then the block 178 checks the status of the microcomputer output line controlling the relays K1 and K2 to determine whether the compressor and condenser fan are on. If this is the case, then the damper heater 70 is turned off to close the damper and prevent further cooling of the fresh food compartment 28. This is desirable since the temperature is outside of a predetermined range surrounding the set point.

If the block 178 determines that the compressor is not on, then the damper heater 70 is turned off and the evaporator fan 32 is de-energized so that no further cooling occurs in either compartment 26,28.

If the block 174 determines that the fresh food compartment temperature is greater than the set point, then a block 184 determines whether the compartment temperature is greater than the set point plus 2° F. If this is the case, then the compartment temperature is outside the range of allowable temperature values for the compartment and, hence, a series of blocks 186, 188 and 190 turn on the damper heater to open the baffle 68, energize the evaporator fan 32, reset the damper off time flag DOFG and reset the damper heater off time to zero seconds.

As can be seen with reference to FIG. 7C and the foregoing description, the control establishes trip point temperatures 2° F. above and below the user selected set point temperature which determine when cooling of the fresh food compartment 28 is initiated and terminated.

Control from each of the blocks 180, 182 and 190 passes to a block 192 which initiates the freezer compartment temperature control routine. The block 192 also assumes control directly from the blocks 176 or 184 if it is determined that the fresh food compartment temperature is within plus or minus 2° F. of the set point temperature.

The block 192 then reads the freezer compartment temperature by sensing the output of the freezer temperature sensor 60. The freezer set point is then detected by a block 194, FIG. 7D, which senses the output of the potentiometer 58. A block 195 then checks to determine whether the frozen crisper flag FCFG is set. If this is the case, control passes to a block 200. Otherwise, a block 196 compares the freezer compartment temperature with the set point. If the freezer temperature is less than or equal to the freezer set point, then a block 198 determines whether the freezer temperature is less than the set point by 5° F. or more. If this is the case, the block 200 checks the status of the compressor protection flag to determine whether this flag is set. If this is not the case, then the compressor has been in either the on or off state for a continuous period of 256 seconds. Control then passes to a block 202 which checks to determine whether the compressor is on.

If the compressor 50 is on, a block 204 sets the compressor protection timer to zero seconds and the compressor protection flag is set by a block 206. A block 208 then checks to determine whether the damper heater element 70 is on by checking the status of the output line which controls the solid state switch 96. If the heating element is not energized, then it has been determined that the baffle 68 is closed and the freezer temperature is more than 5° F. below the set point. Accordingly, to allow the temperature in the freezer to increase, the evaporator fan 32 is de-energized by a block 210 and the compressor is de-energized by a block 212.

On the other hand, if the damper heater 70 is on in turn causing the baffle 68 to be open, then the fresh food compartment is calling for cooling. Consequently, the evaporator fan is maintained in an energized state and only the compressor 50 is de-energized by the block 212.

If the block 196 determines that the freezer compartment temperature is greater than the set point, then a block 214 determines whether the compartment temperature is greater than the set point temperature by a predetermined amount, such as 5° F. If this is the case, then a block 216 determines whether the compressor protection flag CPFG is set. If this is not the case, then the compressor has been either on or off for the required minimum time and hence a block 218 determines whether the compressor is on. If the compressor is not on, a block 220 sets the compressor protection timer to zero seconds and a block 222 sets the compressor protection flag CPFG. A block 224 then turns on the compressor and the evaporator fan to initiate cooling.

As is the case with the plus or minus 2° F. offset for the fresh food compartment trip point temperatures, the plus or minus 5° F. offset for the freezer compartment trip point temperatures is empirically determined. Other offset values may be used, if desired.

Control from either of the blocks 212 or 224 passes back to the block 124, FIG. 7A, to continue the control sequence. Futhermore, control passes to the block 124 from each of the blocks 198 or 214 if the freezer temperature is within a plus or minus 5° F. range of the freezer set point. Control also passes to the block 124 from the blocks 200 or 216 if the compressor protection flag is set, or from the block 202 if the compressor is not on or from the block 218 if the compressor is determined to be on.

Figure 5C:
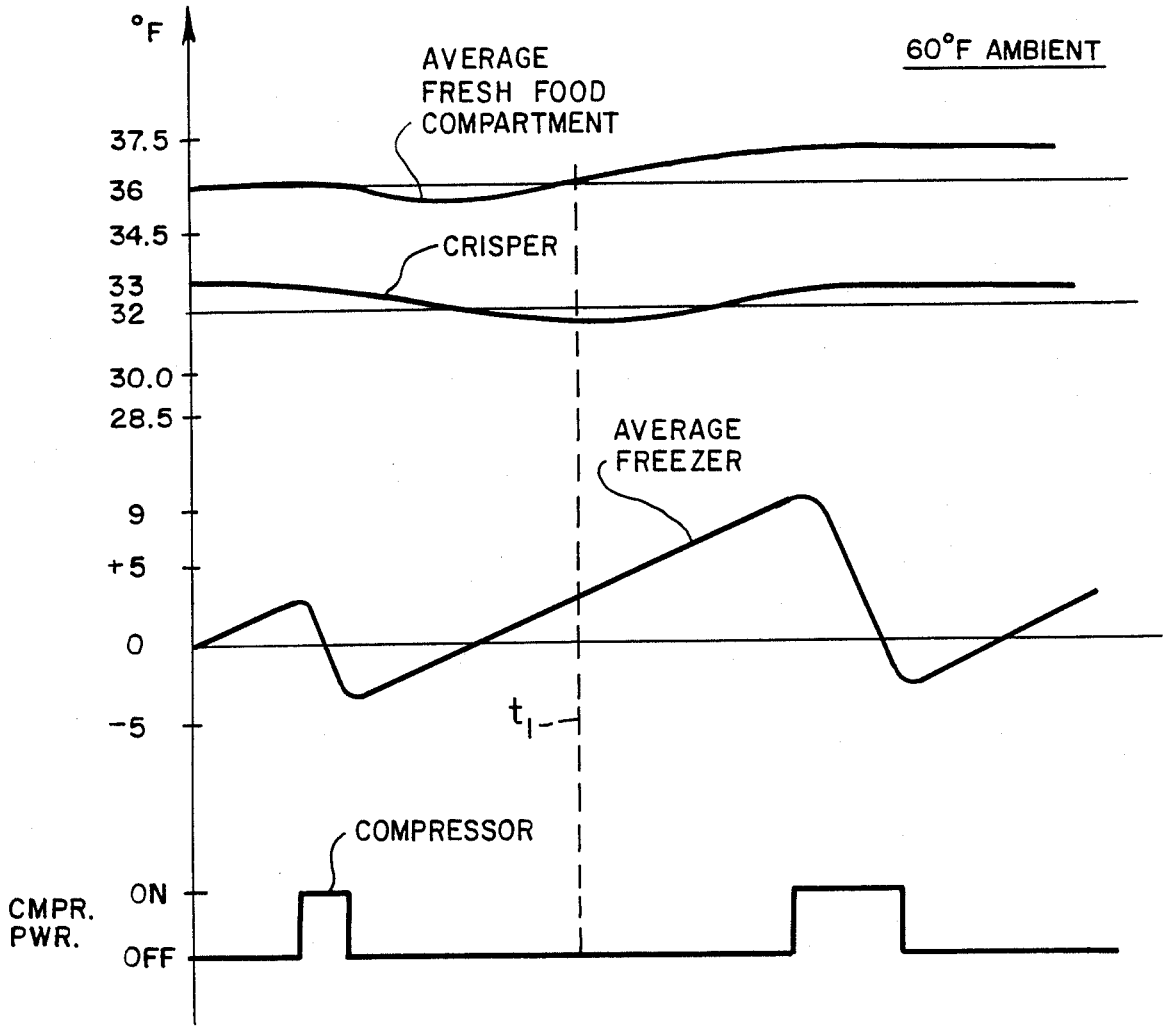

FIG. 5C illustrates the operation of a refrigerator having the same side-by-side cabinet construction as the refrigerator whose performance is illustrated in FIGS. 5A and 5B but which has been provided with the improved control of the present invention. In particular, FIG. 5C illustrates how the present control operates to reduce or eliminate the "freezing crisper" condition when the refrigerator is operated in a 60° F. ambient temperature. Again, it should be noted that the compartment temperatures shown in this figure represent true average temperatures obtained by averaging the outputs of a plurality of thermocouples located within each compartment, whereas the control of the present invention operates from inputs received from a single temperature sensor located within each compartment. Therefore, it will be understood with reference to this figure that while the control of the illustrated embodiment is operated with fresh food compartment and freezer compartment trip point temperatures of ±2° F. and ±5° F. of the respective set point temperatures, the average compartment temperatures illustrated in this figure differ slightly from the actual temperatures experienced by the fresh food and freezer compartment sensors 62,60.

As illustrated in FIG. 5C, the operation of the compressor is determined by the temperature within the freezer compartment, rather than by the temperature within the fresh food compartment, as in conventional refrigerators. Thus, the compressor is cycled on in the first instance at the point where the average freezer compartment temperature reaches +3° F., and is cycled off once the compartment temperature has been reduced to −3° F., these being the points at which the temperature at sensor 60 reaches +5° F. and −5° F., respectively. Although cooling is directly supplied to only the freezer compartment during this period, the temperature of the fresh food compartment drops slightly in response to the reduced temperature of the adjacent freezer compartment, as illustrated. Cooling has not been actively supplied to the fresh food compartment at this point because its temperature remains at or below the trip point temperature. When the average freezer compartment temperature again reaches 3° F. at time $t_1$, this corresponding to the point at which the actual temperature of the freezer sensor 60 reaches the +5.° F. trip point, the compressor would normally be re-energized. Re-energization of the compressor is, however, prevented at this point because the control 21 has previously detected the failure of the fresh food compartment temperature to rise to the predetermined level of 35° F. within 30 minutes of the time cooling was last supplied to fresh food compartment 28, indicating the existence of the freezing crisper condition. Since, as previously noted, the true average fresh food compartment temperature shown in FIG. 5C differs somewhat from the actual temperature of sensor 62, it is not possible from this figure to determine at what point the control 21 first detected the freezing crisper condition. It is, however, clear that this condition had been detected at time $t_1$, since the operation of the compressor was prevented at this point.

As illustrated, the temperature within the freezer is allowed to continue to increase beyond its normal trip point once the freezing crisper condition is detected, causing an eventual increase in the temperature within the fresh food compartment. Once the temperature at sensor 62 within this compartment reaches the predetermined level of 37° F., the control resets the freezing crisper flag and the compressor is again permitted to be re-energized.

In essence, once a freezing crisper condition is detected, operation of the compressor is switched from the freezer temperature sensor 60 to the fresh food temperature 62, the compressor being prevented from being re-energized until the fresh food compartment temperature has reached a predetermined level.

With further reference to FIG. 5C, it can be seen that the crisper temperature remained above freezing for most of the time interval illustrated and, during the brief interval when the temperature did drop below freezing, the temperature did not drop below 31.5° F. A comparison of this crisper temperature with that illustrated in FIG. 5B demonstrates the considerable improvement which is attainable through the use of the present control.

Referring now to FIGS. 8A and 8B, there is illustrated a first alternative embodiment of the present invention which may be utilized to minimize the occurrence of an abnormal temperature condition in the fresh food compartment 28. This is accomplished by energizing means to create a zone of reduced air pressure in the freezer compartment 26 adjacent the return air duct to minimize transfer of cooled air from the freezer compartment to the fresh food compartment when the above-described abnormal temperature condition is sensed.

Referring specifically to FIGS. 8A and 7C, the yes branch from the decision block 173 of FIG. 7C is coupled to a block 250 which turns the damper heater 70 off to close the baffle 68. The evaporator fan 32 is energized to set up an air flow in the freezer and evaporator compartments, in turn creating the zone of reduced air pressure adjacent the return air duct 46. Following the block 250, control passes to the block 192, FIG. 7C, rather than to the block 178 previously note in connection with the preferred embodiment of the invention.

Figure 7D:
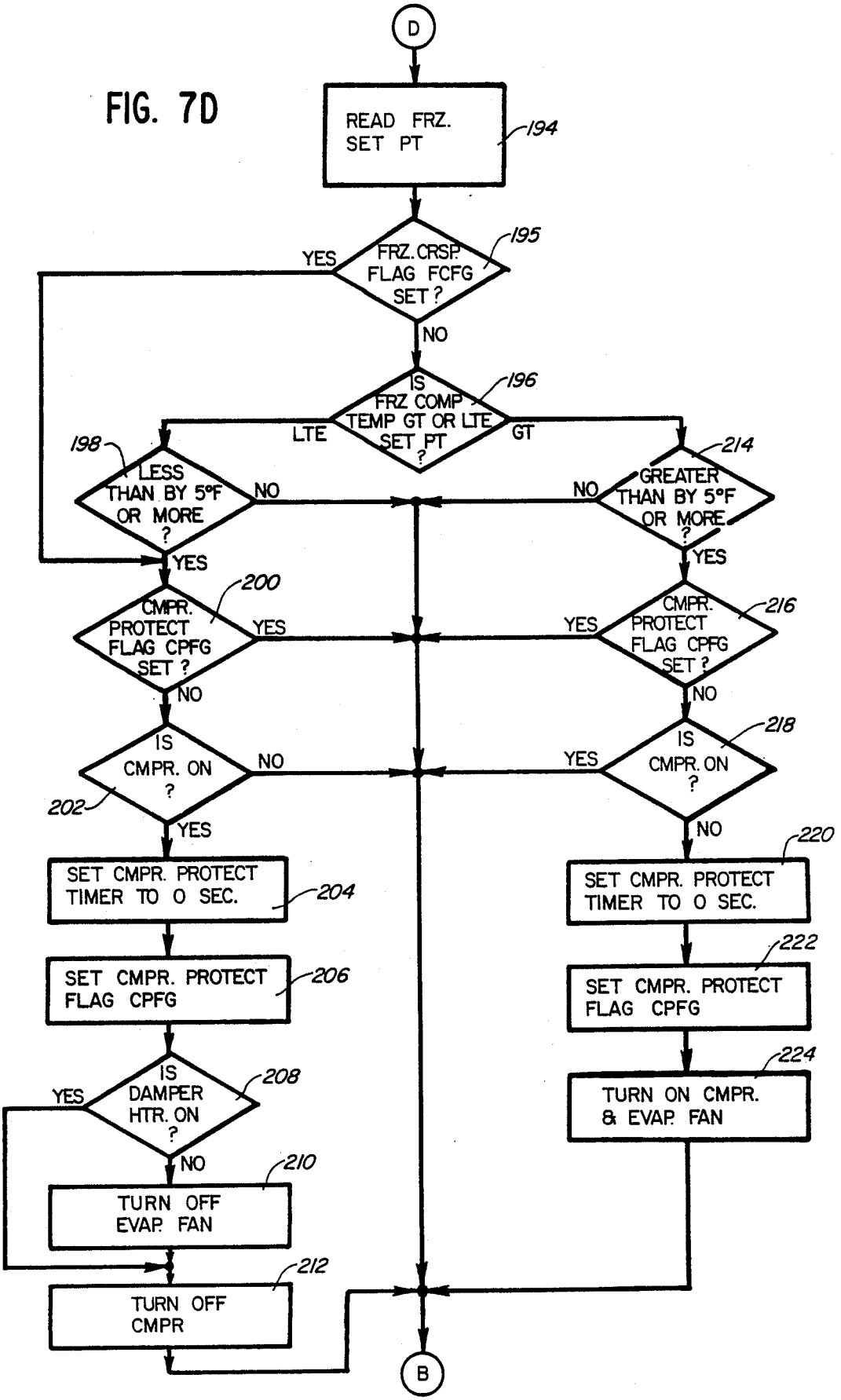

Referring now to FIGS. 8B and 7D, a block 252 follows the block 206 and determines whether the frozen crisper flag FCFG is set. If this is not the case control passes to the block 208, described above in connection with FIG. 7D. Otherwise, control bypasses the block 208 and the block 210, thereby keeping the evaporator fan in its energized state. The block 212 then turns off the compressor and control returns to the point B in FIG. 7A.

Figure 9:
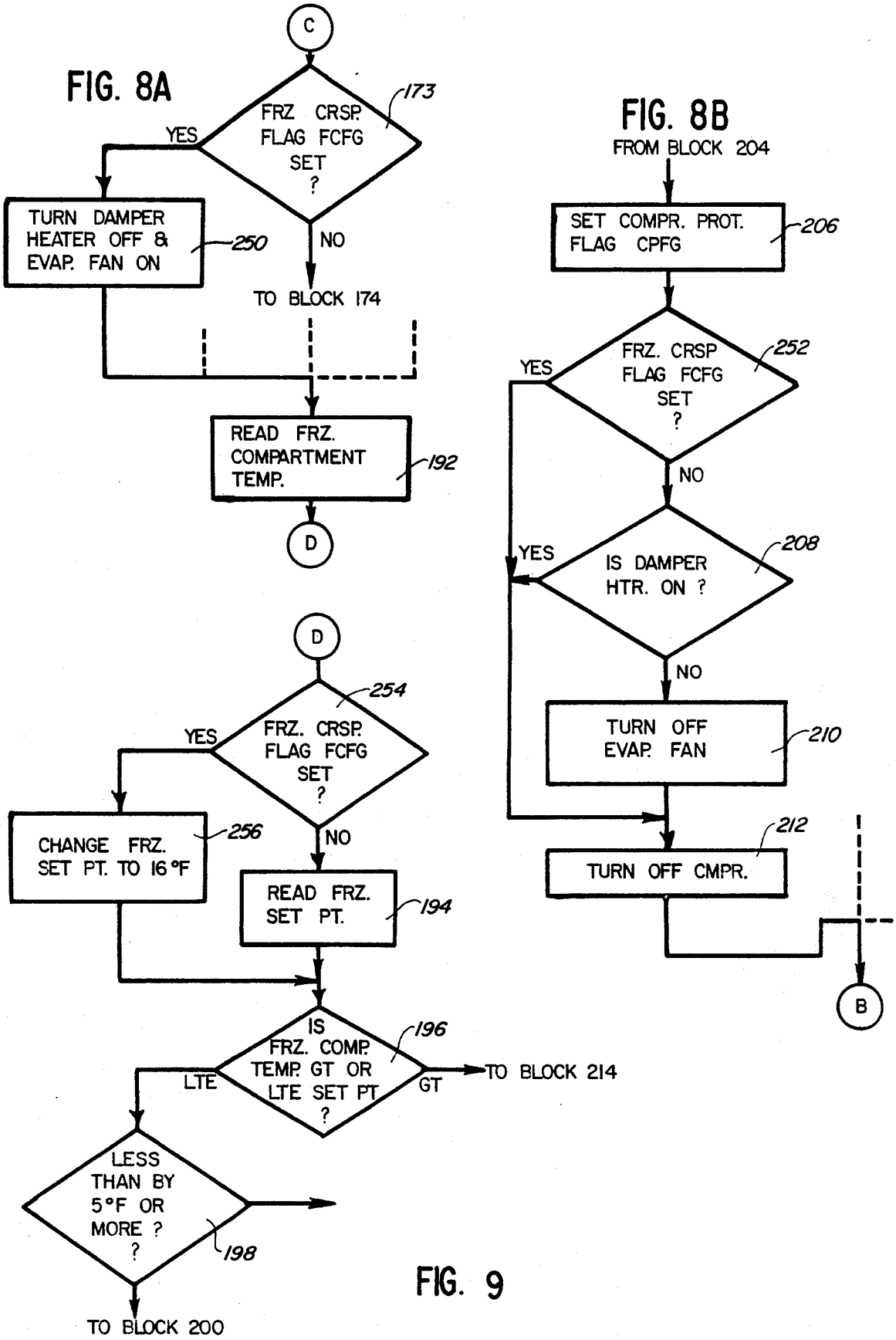
FIG. 9 illustrates the changes to the control program shown in FIGS. 7A-7D to implement a second alternative embodiment of the invention.

Referring now to FIG. 9, there is illustrated a modification to the control program to implement a second alternative embodiment of the invention. In this embodiment, upon the detection of the abnormal temperature condition, the freezer set point temperature is temporarily changed to a warmer value so that the freezer compartment temperature rises to a warmer level. This tends to reduce the cooling of the fresh food compartment by the freezer, and has the effect of delaying operation of the compressor.

Referring to FIGS. 9 and 7D, a block 254 immediately follows the point D in FIG. 7D and checks to determine whether the frozen crisper flag FCFG is set. If this is the case, then a frozen crisper condition has been detected and control passes to a block 256 which changes the freezer set point to a predetermined value, such as 16° F. It should be noted that this predetermined value may be varied, if desired.

Control from the block 256 then passes to the block 196, FIG. 7D.

If the block 254 determines that the frozen crisper flag FCFG is not set, control passes to the block 194 which reads the freezer set point. Control then passes directly to the block 196. It should be noted that the block 195 shown in FIG. 7D is eliminated entirely in this embodiment.

A third alternative embodiment of the invention minimizes the incidence of abnormal temperature conditions by energizing a resistive heating element 260 shown in dotted lines in FIG. 4 which is disposed in the lower portion of the fresh food compartment. The resistive heater 260 is energized only during periods when the abnormal temperature condition is detected, the heater being controlled by a solid state switch 262 which is in turn operated by the microcomputer 80.

Figure 10A:
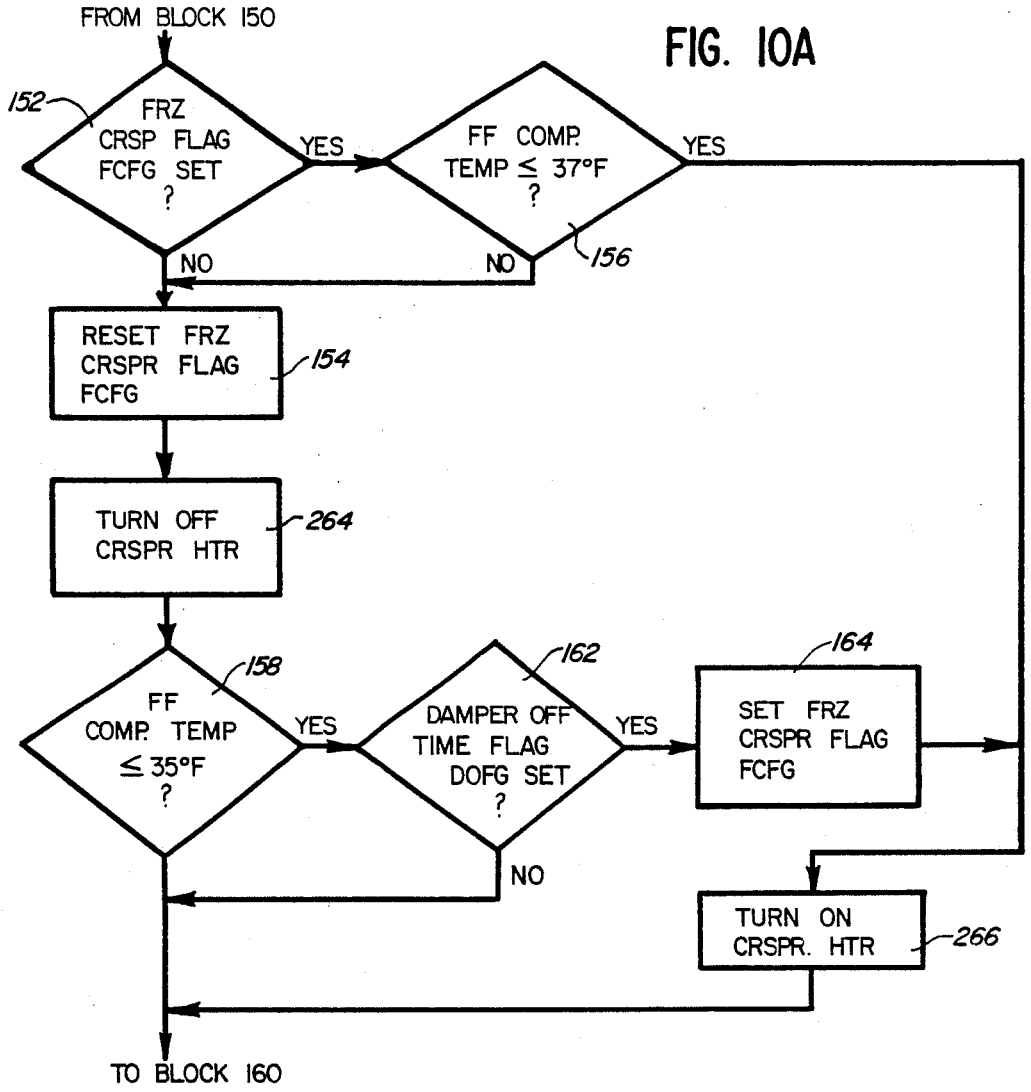
FIGS. 10A and 10B illustrate the changes to the control program shown in FIGS. 7A-7D to implement a third alternative embodiment of the invention.

Referring specifically to FIGS. 10A and 7B, if it is determined by the blocks 152 and 156 that the abnormal temperature condition does not exist, a block 264 turns off the crisper heater 260 by de-energizing the output line controlling the solid state switch 262. On the other hand, if the blocks 152 and 156 determine that the abnormal condition has arisen, then a block 266 turns on the crisper heater 260 to raise the temperature in the vicinity thereof and thereby correct the abnormal condition. Control from the block 266 then passes to the block 160, FIG. 7B.

Figure 10B:
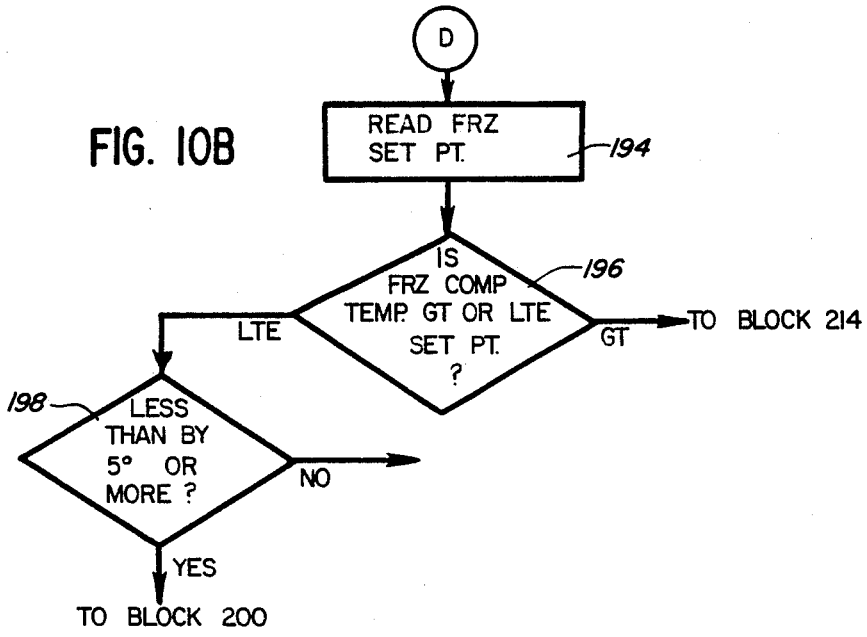

Referring also to FIGS. 10B and 7D, the control process for this embodiment entirely deletes the block 195 and its associated branches t the blocks 196 and 200.

In a fourth alternative embodiment of the invention, the crisper heater 260 is energized when the damper heater 70 is de-energized and, conversely, the crisper heater 260 is de-energized when the damper heater 70 is energized. Thus, the crisper heater 260 is energized whenever cooling is not being actively supplied to the fresh food compartment 28 regardless of whether the abnormal temperature condition has been detected. In this embodiment, the fresh food and freezer temperatures are controlled as noted with respect to previous embodiments.

Figure 11A:
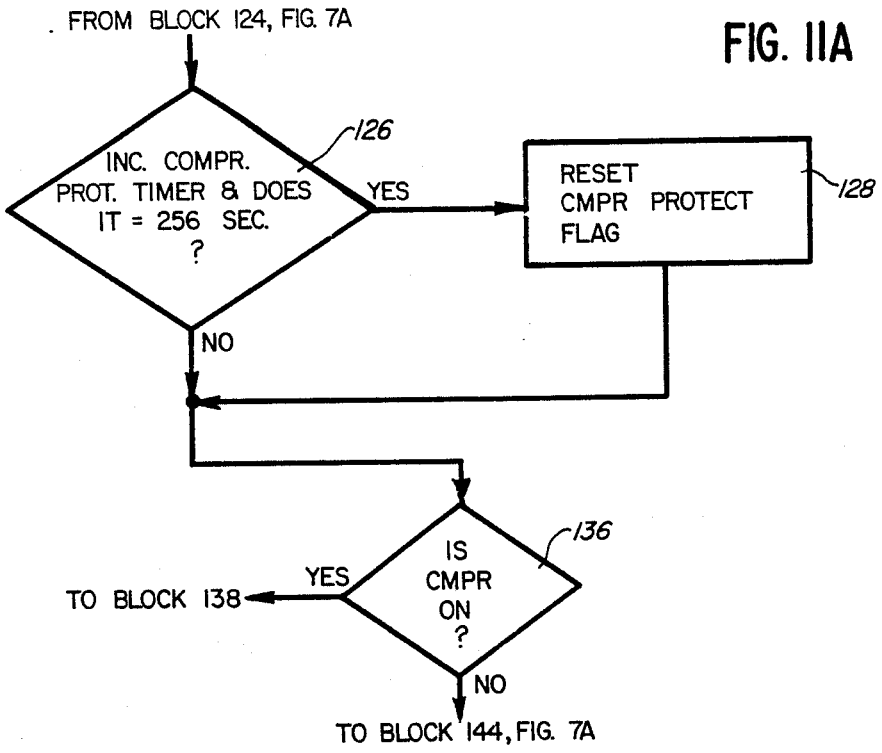

Referring now to FIGS. 11A and 7A, the blocks 130,132,134 shown in FIG. 7A are deleted entirely and control from the blocks 126 and 128 passes directly to the block 136.

Figure 11B:
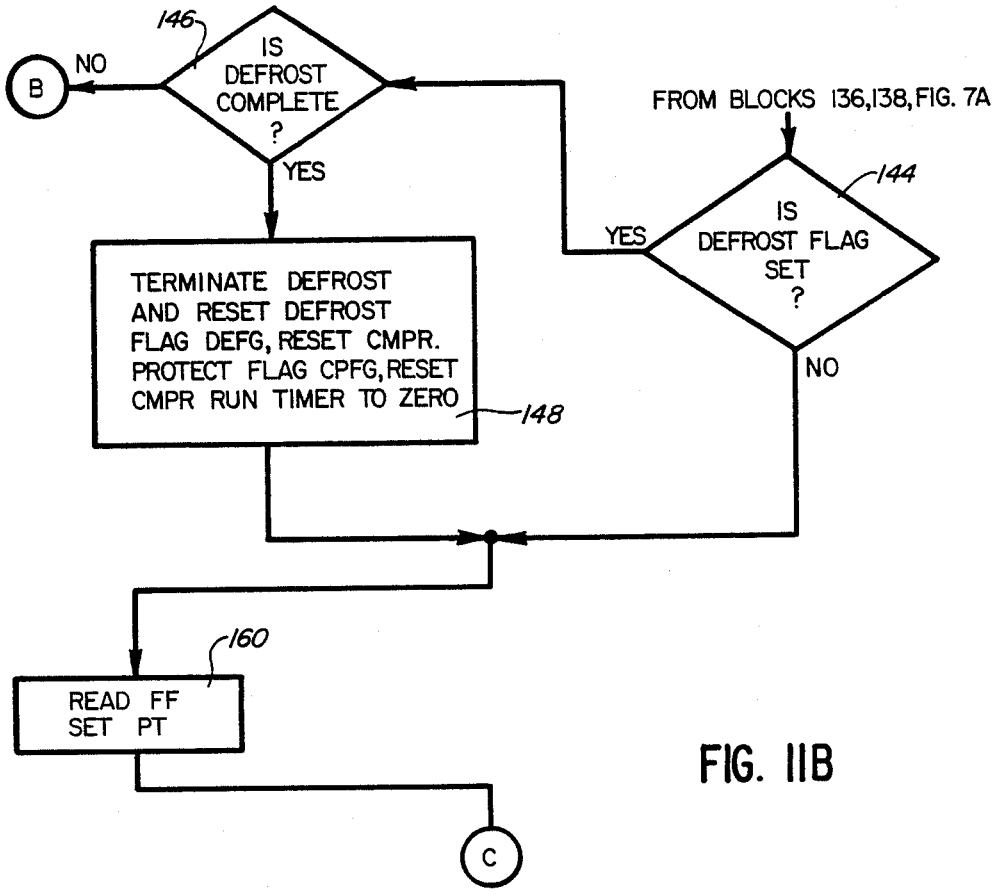

Referring also to FIG. 11B, control from the blocks 144 and 148 completely bypasses the blocks 150,152,154,156, 158,162,164 of FIG. 7B and control passes directly to the block 160 which reads the fresh food set point.

Figure 11C:
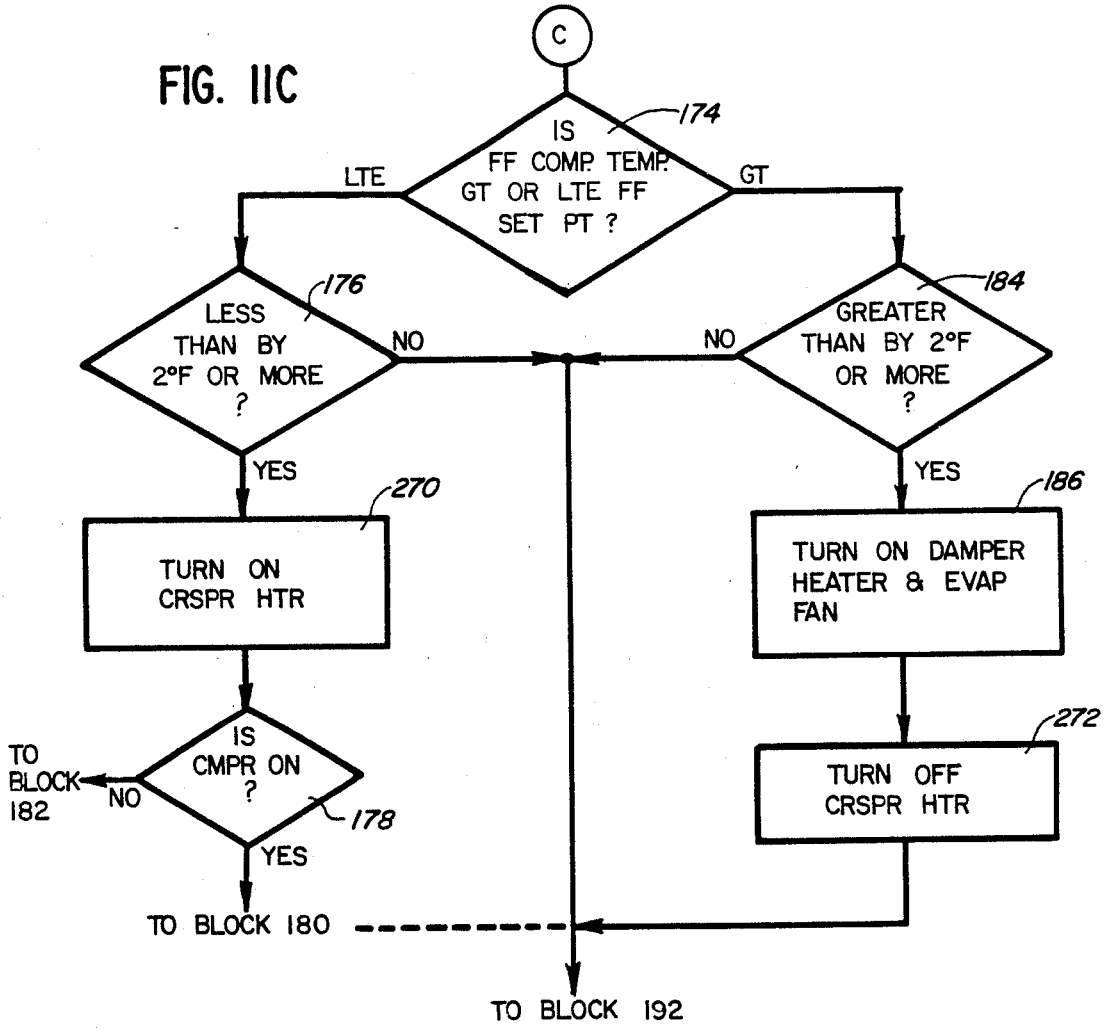

As seen in FIG. 11C, the block 173 of FIG. 7C is eliminated entirely and a block 270 assumes control immediately following the block 176. At this point, if it has been determined by block 176 that the fresh food compartment temperature is less than the fresh food set point by more than 2° F., then control passes to block 270 which energizes the crisper heater 260. Control then passes to the block 178 to continue the control process.

If it is determined by the block 174 and the block 184 that the fresh food compartment temperature is greater than the fresh food set point by more than 2° F., then a block 272 turns off the crisper heater. Control from the block 272 then passes directly to the block 192, and the blocks 188 and 190, shown in FIG. 7C, are eliminated entirely.

Figure 11D:
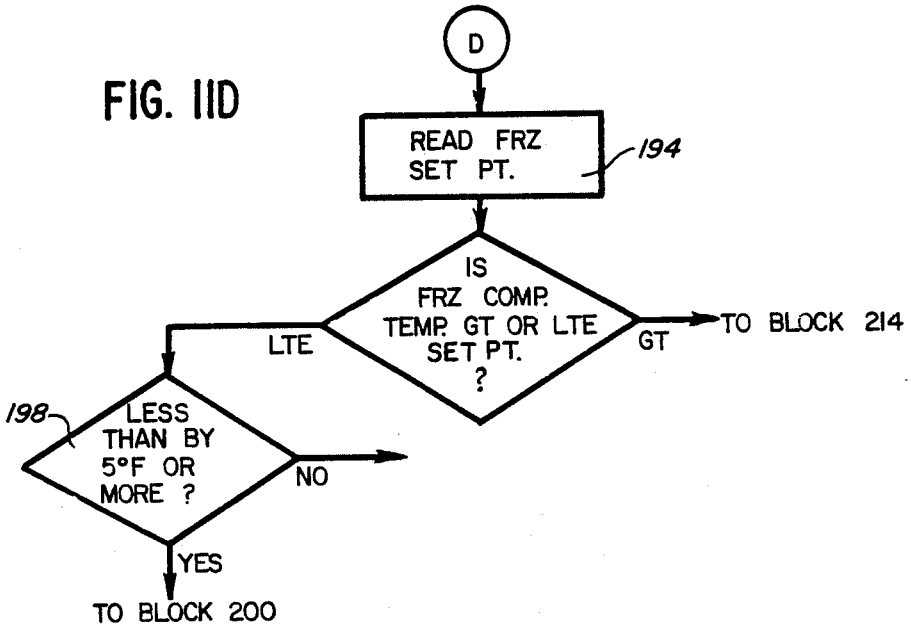

As seen in FIG. 11D, the block 195 shown in FIG. 7D is eliminated entirely, similar to the embodiment disclosed in connection with FIG. 10B.

In each of the control processes described above, the incidence of abnormal temperature conditions within the fresh food compartment is reduced or eliminated entirely by sensing the existence of an abnormal condition in a particular portion of the fresh food compartment at a location remote from the particular location and by taking corrective action upon the sensing of the abnormal condition.

Having described the invention, the embodiments of the invention in which an exclusive property or privilege is claimed are defined as follows:

1. In a refrigerator apparatus having juxtaposed above-freezing and below-freezing compartments and refrigeration means which is cycled on and off the supply cooling to the compartments, an improved control means for reducing the incidence of an undesirable temperature condition in the above-freezing compartment while the cooling means is off, comprising:

means for detecting when the temperature of the above-freezing compartment has failed to rise above a particular temperature within a preselected length of time indicating that a preselected portion of the above-freezing compartment is at an undesirably low temperature wherein the detecting means is disposed remotely from the preselected portion of the above-freezing compartment; and temperature correction means responsive to the detecting means and operative when the temperature of the above-freezing compartment has failed to rise above the particular temperature within the certain length of time for causing the temperature of the preselected compartment portion to approach a desired temperature.

2. The improved control means of claim 1, wherein the temperature correction means includes means for preventing operation of the refrigeration means until the temperature of the above-freezing compartment reaches a certain temperature.

3. The improved control means of claim 1, further including means for selecting a desired temperature for each compartment, and wherein the temperature correction means includes means for raising the desired temperature of the below-freezing compartment when the temperature of the above-freezing compartment has failed to rise above a particular temperature within a preselected length of time.

4. The improved control means of claim 1, wherein the refrigeration means includes an evaporator and evaporator fan in an evaporator compartment which communicates with the above-freezing compartment through a return air duct, and wherein the temperature correction means includes pressure reduction means for creating a zone of reduced air pressure in the evaporator compartment adjacent the return air duct when the temperature of the above-freezing compartment has failed to rise above a particular temperature within a preselected length of time. to minimize transfer of cooled air into the abovefreezing compartment.

5. The improved control means of claim 4, wherein the evaporator compartment also communicates with the above-freezing compartment through a passage having a controllable damper which is operable in a closed state to close the passage and in an open state to allow cooled air to pass into the above-freezing compartment, and wherein the pressure reduction means includes means for maintaining the controllable damper in the closed state and means for energizing the evaporator fan when temperature of the above-freezing compartment has failed to rise above a particular temperature within a preselected length of time.

6. The improved control means of claim 1, further including a heater in the above-freezing compartment and wherein the temperature correction means includes means coupled to the heater and to the detecting means for operating the heater when the temperature of the above-freezing compartment has failed to rise above a particular temperature within a preselected length of time.

7. The improved control means of claim 6, further including a passage for delivering refrigerated air to the above-freezing compartment having a damper therein operable in a closed state to close the passage and in an open state to allow cooled air to pass into the above-freezing compartment and wherein the temperature correction means includes means for closing the controllable damper when the heater is operated.

8. The improved control means of claim 7, further including a passage for delivering refrigerated air to the above-freezing compartment having a controllable damper therein which is periodically operated in an open state to provide cooling to the above-freezing compartment and which is otherwise operated in a closed state to close the passage and wherein the temperature correction means includes means for de-energizing the heater when the damper is operated in the open state.

9. In a refrigerator apparatus having juxtaposed above-freezing and below-freezing compartments and refrigeration means switchable between a cooling mode to supply cooling to the compartments and an off mode wherein no cooling is supplied to the compartments, an improved control means for minimizing the occurrence of an abnormal temperature condition in a preselected portion of the above-freezing compartment, comprising:

a temperature sensor in the above-freezing compartment;

timing means for indicating the length of time since the refrigeration means was switched to the off mode;

abnormal temperature condition means coupled to the temperature sensor and to the timing means for detecting an abnormal temperature condition wherein the temperature in the above-freezing compartment has failed to rise above a particular temperature within a preselected length of time wherein the abnormal temperature condition detecting means is disposed remotely from the preselected portion; and temperature correction means coupled to the abnormal condition detecting means for initiating corrective action to eliminate the abnormal temperature condition when such condition is detected.

10. The improved control means of claims 9, wherein the temperature correction means includes means for maintaining the refrigeration means in the off mode until the temperature of the above-freezing compartment reaches a certain temperature.

11. The improved control means of claim 9, further including means for selecting a set point temperature for each compartment, and wherein the temperature correction means includes means for raising the set point temperature of the below-freezing compartment when the abnormal temperature condition is detected.

12. The improved control means of claim 10, wherein the refrigeration means includes an evaporator and evaporator fan in an evaporator compartment which communicates with the above-freezing compartment through means including a return air duct, and wherein the temperature correction means includes pressure reduction means for creating a zone of reduced air pressure in the evaporator compartment adjacent the return air duct when the abnormal condition is detected to minimize transfer of cooled air into the above-freezing compartment.

13. The improved control means of claim 9, further including a heater in the above-freezing compartment and wherein the temperature correction means includes means coupled to the heater and to the detecting means for operating the heater when the abnormal temperature condition is sensed.

14. The improved control means of claim 13, further including a passage for supplying refrigerated air to the above-freezing compartment, the passage having a damper therein operable in a closed state to close the passage and in an open state to allow refrigerated air to pass into the above-freezing compartment and wherein the temperature correction means includes means for closing the controllable damper when the heater is operated.

15. In a refrigeration apparatus having juxtaposed above-freezing and below-freezing compartments and refrigeration means operable to supply cooling to the compartments, an improved control means comprising:

a temperature sensor in the above-freezing compartment for sensing the temperature therein;

timing means for indicating the length of time since the refrigeration means last supplied cooling to the above-freezing compartment;

detecting means coupled to the temperature sensor and to the timing means for detecting an abnormal temperature condition in the above-freezing compartment wherein the temperature of the compartment does not rise above a first predetermined temperature within a preselected length of time since the refrigeration means last supplied cooling to the above-freezing compartment indicating that a preselected portion of the above-freezing compartment is at an undesirably cold temperature wherein the detecting means is disposed remotely from the preselected portion; and cooling disabling means coupled to the detecting means for preventing further operation of the refrigeration means when the abnormal temperature condition is detected until the temperature within the above-freezing compartment has reached a second predetermined temperature.

16. In a refrigeration apparatus having juxtaposed above-freezing and below-freezing compartments and refrigeration means operable to supply cooling to the compartments, an improved control means, comprising:

a temperature sensor in the above-freezing compartment for sensing the temperature therein;

timing means for indicating the length of time since the refrigeration means last supplied cooling to the above-freezing compartment;

detecting means coupled to the temperature sensor and to the timing means for detecting an abnormal temperature condition in the above-freezing compartment wherein the temperature of the compartment does not rise above a first predetermined temperature within a preselected length of time since the refrigeration means last supplied cooling to the above-freezing compartment;

set point selection means for selecting a desired set point temperature for the below-freezing compartment;

set point adjustment means responsive to the detecting means for automatically increasing the set point temperature when the abnormal temperature condition is detected in the above-freezing compartment; and cooling disabling means coupled to the detecting means for preventing further operation of the refrigeration means when the abnormal temperature condition is detected until the first occurrence of an event selected from a set comprising the temperature within the above-freezing compartment reaching a second predetermined temperature and the temperature within the below-freezing compartment reaching the adjusted set point temperature.

17. In a refrigerator apparatus having juxtaposed above-freezing and below-freezing compartments separated by a divider wall, refrigeration means including an evaporator and an evaporator fan for circulating cooled air in the compartments and a return air duct between the above-freezing compartment and the evaporator, an improved control means for correcting an undertemperature condition in a preselected portion of the above-freezing compartment, comprising:

a temperature sensor in the above-freezing compartment for sensing the temperature therein disposed remotely from the preselected portion;

timing means for indicating the length of time since the refrigeration means last supplied cooling to the above-freezing compartment;

detecting means coupled to the temperature sensor and to the timing means for detecting an abnormal temperature condition in the above-freezing compartment wherein the temperature of the compartment does not rise to a first predetermined temperature within a predetermined length of time since the cooling means last supplied cooling to the above-freezing compartment; and pressure reduction means coupled to the detecting means, the evaporator fan and the controllable damper for creating a zone of reduced air pressure adjacent the return air duct when the abnormal temperature condition is detected to minimize transfer of cooled air from the below-freezing compartment to the above-freezing compartment.

18. The improved control means of claim 17, further including a controllable damper operable in an open state and a closed state to control the flow of cooled air into the above-freezing compartment and wherein the pressure reduction means further includes means for operating the controllable damper in the closed state and means for energizing the evaporator fan when the abnormal temperature condition is detected.

19. In a refrigeration apparatus having juxtaposed above-freezing and below-freezing compartments, set point selecting means for individually selecting the desired set temperature for each of the compartments and refrigeration means responsive to the set point selection means for controlling the temperature of each of the compartments in response to the set point temperatures, an improved control means for correcting an undertemperature condition in a preselected portion of the above-freezing compartment, comprising:

a temperature sensor in the above-freezing compartment for sensing the temperature therein disposed remotely from the preselected portion;

timing means for indicating the length of time since cooling was last supplied to the above-freezing compartment;

detecting means coupled to the temperature sensor and to the timing means for detecting an abnormal temperature condition in the above-freezing compartment wherein the temperature of the compartment does not rise to a first predetermined temperature within a particular length of time since cooling was last supplied to the above-freezing compartment; and means coupled to the detecting means for raising the desired set point temperature for the belowfreezing compartment when the abnormal temperature condition is detected to thereby allow the temperature of the above-freezing compartment to increase before cooling is again supplied to the below-freezing compartment.

20. In a refrigeration apparatus having juxtaposed above-freezing and below-freezing compartments and refrigeration means operable to supply cooling to the compartments, an improved control means for reducing the incidence of an abnormal temperature condition in a preselected portion of an above-freezing compartment comprising:

a temperature sensor in the above-freezing compartment for sensing the temperature therein disposed remotely from the preselected portion;

timing means for indicating the length of time since cooling was last supplied by the refrigeration means to the above-freezing compartment;

detecting means coupled to the temperature sensor and to the timing means for detecting an abnormal temperature condition in the above-freezing compartment wherein the temperature of the compartment does not rise to a predetermined temperature within a predetermined length of time since cooling was last supplied by the refrigeration means to the fresh food compartment;

a heater in the above-freezing compartment; and means coupled to the heater and to the detecting means for operating the heater when the abnormal temperature condition is sensed to thereby eliminate the abnormal temperature condition.

21. The improved control means of claim 20, further including a passage between the above-freezing and below-freezing compartments and a controllable damper disposed in the passage and operable in open and closed states to open or close the passage, respectively, and means for operating the damper in the closed state when the heater is operated.

22. The improved control means of claim 21, further including a passage between the above-freezing and below freezing compartments, a controllable damper disposed in the passage and operable in open and closed states to open or close the passage, respectively, and means for periodically switching the damper between the open and closed states to control the temperature in the above-freezing compartments and wherein the heater operating means includes means for energizing the heater only when the abnormal temperature condition is detected and the damper is in the closed state.

23. In a refrigerator apparatus having juxaposed above-freezing and below-freezing compartments and refrigeration means for supplying cooling to the compartments, an improved control means comprising:

a temperature sensor disposed in a first portion of the above-freezing compartment;

timing means for indicating a time interval;

detecting means responsive to the sensor and the timing means and operative during period when the refrigeration means is de-energized for detecting when the temperature of the above-freezing compartment has failed to rise above a particular temperature within a preselected length of time indicating the existence of an undesirably low temperature in a second portion of the above-freezing compartment wherein the detecting means is disposed remotely form the second portion; and temperature correction means responsive to the detecting means for causing the temperature of the second compartment portion to approach a desired temperature before permitting further cooling of the second compartment portion.

24. The improved control means of claim 23, wherein the temperature correction means includes means for preventing operation of the refrigeration means until the temperature of the first compartment portion reaches a certain temperature.

25. The improved control means of claim 23, further including means for selecting a desired temperature for each compartment, and wherein the temperature correction_means includes means for raising the desired temperature of the below-freezing compartment when temperature of the above-freezing compartment has failed to rise above a particular temperature within a preselected length of time.

26. The improved control means of claim 23, wherein the refrigeration means includes an evaporator and evaporator fan in an evaporator compartment which communicates with the above-freezing compartment through a return air duct, and wherein the corrective means includes pressure reduction means for creating a zone of reduced air pressure in the evaporator compartment adjacent the return air duct when the temperature of the above-freezing compartment has failed to rise above a particular temperature within a preselected length of time to minimize transfer of cooled air into the above-freezing compartment.

27. The improved control means of claim 26, wherein the evaporator compartment also communicates with the abovefreezing compartment through a passage having a controllable damper which is operable in a closed state to close the passage or an open state to allow cooled air to pass into the above-freezing compartment, and wherein the pressure reduction means includes means for operating the controllable damper in the closed state and means for energizing the evaporator fan when the temperature of the above-freezing compartment has failed to rise above a particular temperature within a preselected length of time.

28. The improved control means of claim 23, further including a heater disposed in the first portion of the above-freezing compartment and wherein the corrective means includes means coupled to the heater and to the detecting means for operating the heater when the temperature of the above-freezing compartment has failed to rise above a particular temperature within a preselected length of time.

* * * * *